United States Patent [19]

Muck

[11] Patent Number: 4,773,832

[45] Date of Patent: Sep. 27, 1988

[54] PUMP

[75] Inventor: Jack E. Muck, Garfield Heights, Ohio

[73] Assignee: AccuSpray, Inc., Cleveland, Ohio

[21] Appl. No.: 545,090

[22] Filed: Oct. 25, 1983

[51] Int. Cl.[4] ..... F04B 43/08; F01B 19/00

[52] U.S. Cl. ..... 417/474; 92/99; 92/103 SD

[58] Field of Search ..... 92/99, 103 SD; 417/474

[56] References Cited

U.S. PATENT DOCUMENTS

| | | | |
|---|---|---|---|
| 1,622,517 | 3/1927 | Johnson | 92/99 |
| 2,287,627 | 6/1942 | Malsbary | 92/99 |
| 2,736,332 | 2/1956 | Simmons | 92/103 SD |
| 2,928,426 | 3/1960 | Taylor | 92/99 |
| 3,314,365 | 4/1967 | Ritchie | 92/99 |
| 3,488,763 | 1/1970 | Lofquist, Jr. | 92/99 |
| 4,086,036 | 4/1978 | Hagen | 92/99 |
| 4,192,223 | 3/1980 | Lombard | 92/99 |

*Primary Examiner*—Abraham Hershkovitz
*Attorney, Agent, or Firm*—Sidney W. Millard

[57] ABSTRACT

An improved diaphragm pump in which the diaphragm has a majority of its area available for flexure and deformation thereby allowing for a variable stroke length on the diaphragm pump and decreased wear of the diaphragm in operation. Additionally such a flexible diaphragm is additionally deformed by the pressure of the fluid in the pumping chamber thereby forming a "piston" of the diaphragm as it is deformed over the deforming piston of the pump.

4 Claims, 1 Drawing Sheet

PUMP

FIELD OF THE INVENTION

The invention relates to an improved pump; and more particularly relates to an improved diaphragm pump.

BACKGROUND OF THE INVENTION

Diaphragm pumps are particularly useful in the pumping of liquids, although some uses are known for the pumping of gases with a diaphragm pump. Conventionally diaphragm pumps utilize a circular shaped rigid diaphragm with an elastomeric annularly disposed flexible portion at the outer perimeter. The plate is then reciprocated within a pumping chamber by means of either a direct connected mechanical device or an intervening second fluid on the power side of the diaphragm. The circular plate of the conventional diaphragm pump occupies the majority of the aperture opening of the pumping chamber of the pump. In this way the elastomeric perimeter of the diaphragm becomes heavily flexed during the reciprocating action of the diaphragm within the chamber. Since the flexure of the diaphragm is limited to the elastomeric perimeter, considerable wear and early fatigue failure of the elastomeric portion of the diaphragm commonly occurs. Additionally such a conventional diaphragm in conjunction with check valves at the inlet and outlet ports to the pumping chamber results in an essentially positive displacement type of pump. Of course this is not a true positive displacement pump since the existence of downstream back pressure may only reach a certain value before the pump simply stalls and vibrates without pumping fluid. An additional drawback to such a diaphragm pump is that it is difficult to vary the stroke length of the reciprocating diaphragm into and out of the pumping chamber since all flexure takes place in the perimeter and not in the more rigid central portion of the diaphragm.

Therefore, there is a need for an improved diaphragm pump in which the elastomeric portion of the diaphragm does not have such a high concentration of flexure stresses, and additionally there is a need for an improved diaphragm pump which acts more like a positive displacement pump of the piston variety.

SUMMARY OF THE INVENTION

The present invention is an improved diaphragm pump in which a pump body includes inlet and outlet ports connected to a pumping chamber within the pump body. A diaphragm is disposed over the aperture in the pumping chamber. The rigid portion of the diaphragm occupies only a minority proportion of the area of the diaphragm. Additionally, the diaphragm may be subjected to a variable stroke length from a reciprocating deforming means thereby allowing variation in the amounts and pressures of fluids pumped.

An additional aspect of the present invention provides for a diaphragm, operating in a diaphragm pump environment, to be further deformed by the pressure of the fluid that is being pumped to form a "piston" by the deformation of the diaphragm over the deforming means which are attached to the back side, non-fluid side, of the diaphragm. In this way, a "piston" is formed on each inward stroke of the deforming means and the "piston" seems to disappear upon the retraction of the deforming means to the plane of the aperture in the pumping chamber.

BRIEF DESCRIPTION OF THE DRAWINGS

The best mode contemplated in carrying out this invention is illustrated in the accompanying drawings in which.

DESCRIPTION OF THE PREFERRED EMBODIMENT

Figure 1:
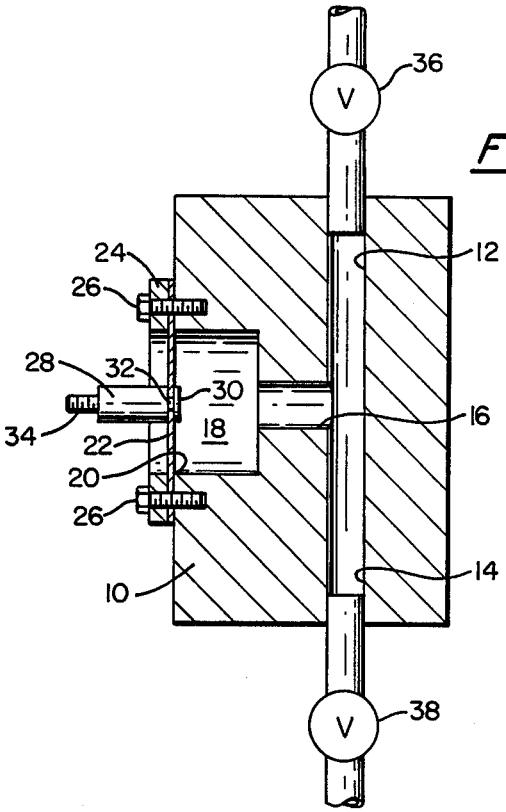
FIG. 1 is a cross sectional view of a pump according to the present invention.

With reference to the drawings, FIG. 1 depicts a cross section of a pump according to the present invention of a type primarily intended for use in pumping paint or other viscous materials, however, the pump is suited for other pumping purposes, too. The pump body 10 is shown as a machined block preferably of a metallic substance. Machined into the block of the pump body 10 are inlet port 12 and outlet port 14. The inlet and outlet ports are shown connected to one another and also connected by means of a connecting passage 16 to pumping chamber 18. The function of the apparatus shown as a pump will be more fully described below. Disposed over the aperture 20 in the end of pumping chamber 18 is diaphragm 22 which is retained in position by a covering plate 24 which itself is held in position by bolt means 26. It is preferred that covering plate 24 be removable for the replacement of the diaphragm.

Centrally located on diaphragm 22 is deformation means 28 which is connected to the diaphragm by means of fastener 30. Fastener 30 engages deformation means 28 through a hole 32 which has been perforated in the center of the diaphragm for this purpose. Deformation means 28 is further connected by connecting means 34 to a reciprocating type driver not shown.

When driven by a reciprocating driver, deformation means 28 will move forward taking the center of diaphragm 22 with it into the central portion of pumping chamber 18. This action is more clearly shown in the subsequent figures, however, the function of the entire unit as a pump is that a fluid to be pumped is admitted through inlet port 12 via check type valve 36 which resides in the inlet and which prevents back flow of the fluid. The pump works best when the entire chamber area and the entire ported area is full of the fluid. When the diaphragm moves forward the pressure on the fluid is increased inside pumping chamber 18. This increase in pressure will close check type valve 36 but will also allow the pressurized fluid to escape from the pump through the outlet port 14 via check type valve 38. When the reciprocating mover moves deformation means 28 back to the plane of aperture 20 the pressure from the fluid is not only relieved but actually reduced below the previous pressure due to the creation of a void area. This will cause check type valve 36 to open, admitting further fluid to the pump.

Figure 2:
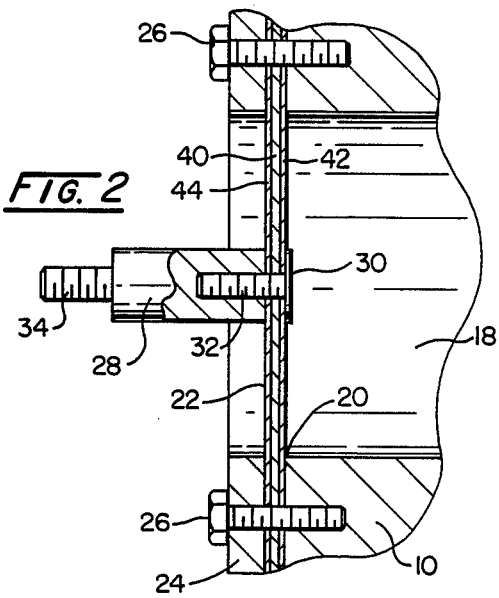
FIG. 2 is a detail cross section of the diaphragm area of the pump of FIG. 1, diaphragm in retracted position.
Figure 3:
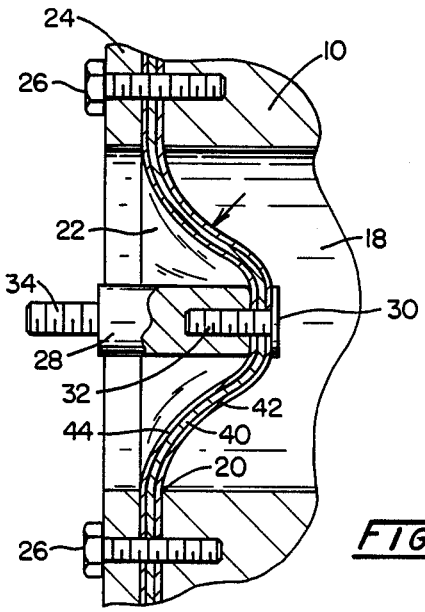
FIG. 3 is a detail of the diaphragm area of the pump of FIG. 1, diaphragm in the deformed position.

The action of the diaphragm according to the present invention and its construction are more clearly understood by reference to FIGS. 2 and 3. In FIG. 2 the diaphragm is shown in its non-deformed position and the diaphragm resides in the plane of the aperture 20 of the pumping chamber 18. The preferred construction of the diaphragm is a sandwich type structure in which the central portion 40 or the "meat" is preferably a highly flexible or neoprene type of material which is capable of absorbing a rather high amount of energy and which does the majority of the deforming. The central portion 40 has a layer of less flexible material 42 and 44, preferably polytetrafluoroethylene type, on both sides of it, which act to spread the stresses of flexure over a wider area of the diaphragm.

In FIG. 3 the diaphragm is shown in its most deformed position, deforming means 28 having been rammed forward by the reciprocating means. The pressure of the fluid, which according to Pascal's Law is equal in all directions and acts with equal force on all points within the pumping chamber, tends to act on the diaphragm to cause a second flexure which forces the diaphragm back around deforming means 28 to form a "piston", the amount of such reverse flexure being a function of the pressure on any given diaphragm assembly. This deflection and shaping is in accordance with the principles of Hooke's Law. The "piston" seems to disappear when the deforming means is moved back to the plane of the aperture 20.

It can be seen from the above that the diaphragm and deforming means arrangement of the present invention can be utilized to effectuate a variable stroke length on any given diaphragm. The stroke length can be varied by adjustments made in the reciprocating means which are attached to the deforming means 28. Additionally, the diaphragm having such a large area over which deformation can occur tends to adjust itself according to the pressure within the pumping chamber, relatively more deformation of the diaphragm back over the deforming means occuring as the pressure increases, thereby adjusting the amount pumped to the downstream pressure and use requirements. It is recommended that the area of the deforming means relative to the active area of the diaphragm as it is disposed across the aperture be not greater than 25 percent and preferably in the range of 8 to 12 percent of the area of the diaphragm. In this way the maximum benefit of the flexure and "piston" features of the improved diaphragm pump according to the present invention can be fully realized.

It will be apparent from the above that the present invention provides an improved diaphragm pump in which the diaphragm may be utilized for variable stroke length and variable pressure requirements of the fluid being pumped. Additionally the diaphragm will have a longer operational life due to the flexure being absorbed across a larger percentage of the diaphragm than was the case in prior art diaphragm pumps.

Having thus described the invention, what is claimed is:

1. A pump comprising means forming a chamber for holding liquid, said chamber being cylindrical and open to form an aperture at one end, means forming an inlet to allow the entrance of liquid into said chamber, a check valve associated with said inlet for preventing the exit of liquid from said chamber through inlet means, means forming an outlet to allow the exit of liquid from said chamber, a check valve associated with said outlet for preventing the entrance of liquid into said chamber from said outlet means, the aperture of said chamber being closed by a flexible diaphragm, said diaphragm comprising a layer of neoprene sandwiched between two layers of polytetrafluoroethylene, each layer being of uniform thickness across the full width of the open end, an annular ring being secured to said means forming said chamber and clamping the edge of the diaphragm in fluid tight engagement between the ring and the means forming the chamber, a perforation in said diaphragm coaxial with the cylindrical chamber, a means for deforming the diaphragm, said deforming means being attached to the diaphragm by a fastener which sealingly engages the surface of the diaphragm around the perforation on the chamber side thereof and extends through said perforation and is attached to said deforming means, said deforming means comprising a cylindrical ram having a cross-sectional area not greater than twenty-five percent of the cross-sectional area of said aperture, means for reciprocating said ram from a position where the diaphragm lies with its surface facing the chamber in a plane across the open end of the chamber to a position where the ram extends into the area of the chamber.

2. The pump of claim 1 including means for varying the stroke length of the ram.

3. The pump of claim 2 wherein the cross-sectional area of said ram is in the range of about eight to about twelve percent of the cross-sectional area of the aperture.

4. The pump of claim 1 wherein the cross-sectional area of said ram is in the range of about eight to about twelve percent of the cross-sectional area of the aperture.

* * * * *